US005607555A

United States Patent [19]

Grossmann et al.

[11] Patent Number: 5,607,555

[45] Date of Patent: Mar. 4, 1997

[54] PAPER MACHINE FORMING SECTION FOR PRODUCING A MULTILAYER PAPER WEB

[75] Inventors: Udo Grossmann; Dieter Egelhof; Albrecht Meinecke, all of Heidenheim, Germany

[73] Assignee: Voith Sulzer Papiermaschinen GmbH, Germany

[21] Appl. No.: 379,267

[22] Filed: Jan. 27, 1995

[30] Foreign Application Priority Data

Jan. 27, 1994 [DE] Germany ..... 44 02 273.5

[51] Int. Cl.[6] ..... D21F 11/04

[52] U.S. Cl. ..... 162/304; 162/133; 162/301

[58] Field of Search ..... 162/304, 300, 162/301, 303, 133

[56] References Cited

U.S. PATENT DOCUMENTS

| | | | |
|---|---|---|---|
| 3,985,612 | 10/1976 | Watanabe | 162/304 |
| 4,153,504 | 5/1979 | Justus | 162/304 |
| 4,830,709 | 5/1989 | Turner et al. | 162/133 |
| 5,045,153 | 9/1991 | Sollinger et al. | 162/301 |
| 5,078,835 | 1/1992 | Schiel et al. | 162/352 |
| 5,389,206 | 2/1995 | Buck et al. | 162/300 |
| 5,427,654 | 6/1995 | Gray et al. | 162/304 |
| 5,456,803 | 10/1995 | Tokuno | 162/304 |

FOREIGN PATENT DOCUMENTS

| | | | |
|---|---|---|---|
| 0489094 | 8/1990 | European Pat. Off. . | |
| 4031038 | 4/1992 | Germany | 162/133 |

*Primary Examiner*—Karen M. Hastings

*Attorney, Agent, or Firm*—Ostrolenk, Faber, Gerb & Soffen, LLP

[57] ABSTRACT

A paper machine forming section with two twin-wire sections for forming a multilayer paper web. Each twin wire web-forming unit consisting of a headbox, two wire loops arranged to define a common wire path for molding the web being formed in sandwich-like manner and drainage elements for each of the wire loops. The common wire path of each web-forming unit has a first section including a curved suction drainage element or roll in the first lower wire loop; a second section including opposing drainage ledges, wherein the drainage ledges are stationary on the upper side and the drainage ledges are developed resiliently pressable on the bottom side; the drainage ledges of the upper and lower sides are arranged staggered with respect to each other in the direction of travel of the wire, and at least the ledges of the upper side are developed with suction; and a third section which has at least one suction wire separating element on one side. The twin-wire forming units are so arranged that the same drainage elements are associated in each case with what will be the inner and outer sides respectively of the respective layer of the multilayer paper web.

7 Claims, 5 Drawing Sheets

PAPER MACHINE FORMING SECTION FOR PRODUCING A MULTILAYER PAPER WEB

BACKGROUND OF THE INVENTION

The present invention relates to a paper machine for the manufacture of a multilayer paper web, and particularly, relates to a paper machine having several twin-wire formers.

Such a paper machine is known from U.S. Pat. No. 4,830,709, which discloses a paper machine for the manufacture of a multilayer paper web using two twin-wire formers. One embodiment shows two twin-wire paths which are formed by three wire loops, wherein the middle wire loop extends through both wire paths. Another embodiment shows a first twin-wire former having a long forwardly extending lower wire on which the paper web formed by the second twin-wire former is applied by the bottom wire of the second twin-wire former. The purpose of these embodiments is to provide a twin-wire former which permits the highest possible range of paper weights and wire speeds.

The embodiments in this prior patent have the disadvantage that one substantial requirement for paper webs is not satisfied, namely that the two surfaces of the multilayer paper web formed have properties which are as uniform as possible in view of the arrangement of the drainage elements.

SUMMARY OF THE INVENTION

The object of the present invention is to provide a paper machine having at least two twin-wire formers which produce a multilayer paper web which has paper properties which are as uniform as possible on both outer sides of the multilayer web.

In the invention, in order to form a multilayer paper web, at least two twin-wire formers are used. Each former produces an outer paper web layer of the multilayer web. The liquid or water drainage elements of both twin-wire formers are arranged such that the two webs of which the multilayer web is comprised have the same properties on their respective outer or outwardly facing sides and on their respective inner or inwardly facing sides. This is achieved by forming the paper web with "mirror-imagery". This means that each twin-wire former is developed such that, for instance, the outside of each paper web layer produced contacts the first curved drainage element and then the following resiliently applied drainage elements, while those sides of each of the paper web layers formed, which lie on the inside in the final web, contact the stationary drainage elements of the twin-wire former.

This development produces a very uniform type of paper. By suitably developing and arranging the drainage ledges depending on the requirements, the proportions of filler and/or fines may be pushed more toward the outsides of the web layers. For example, adherence of the two web layers to each other can be improved because the proportions of fines are shifted toward the outsides of the paper web layers. As a result, a larger number of fibers are present on the inner, facing sides of the two web layers which rest against each other. This provides a better mutual "anchoring" of the layers. As a result, there is better adherence of the two layers after they are couched.

A further advantage of the invention is that, with at least equivalent or even better forming and at least equivalent and frequently better properties of the sheet such as, for instance, better constancy of the base weight profile and less dispersion of the strength values, the twin-wire formers produce a saving of energy, in contrast to hybrid formers.

Other features and advantages of the present invention will become apparent from the following description of the invention which refers to the accompanying drawings.

DESCRIPTION OF THE PREFERRED EMBODIMENTS

Figure 1:
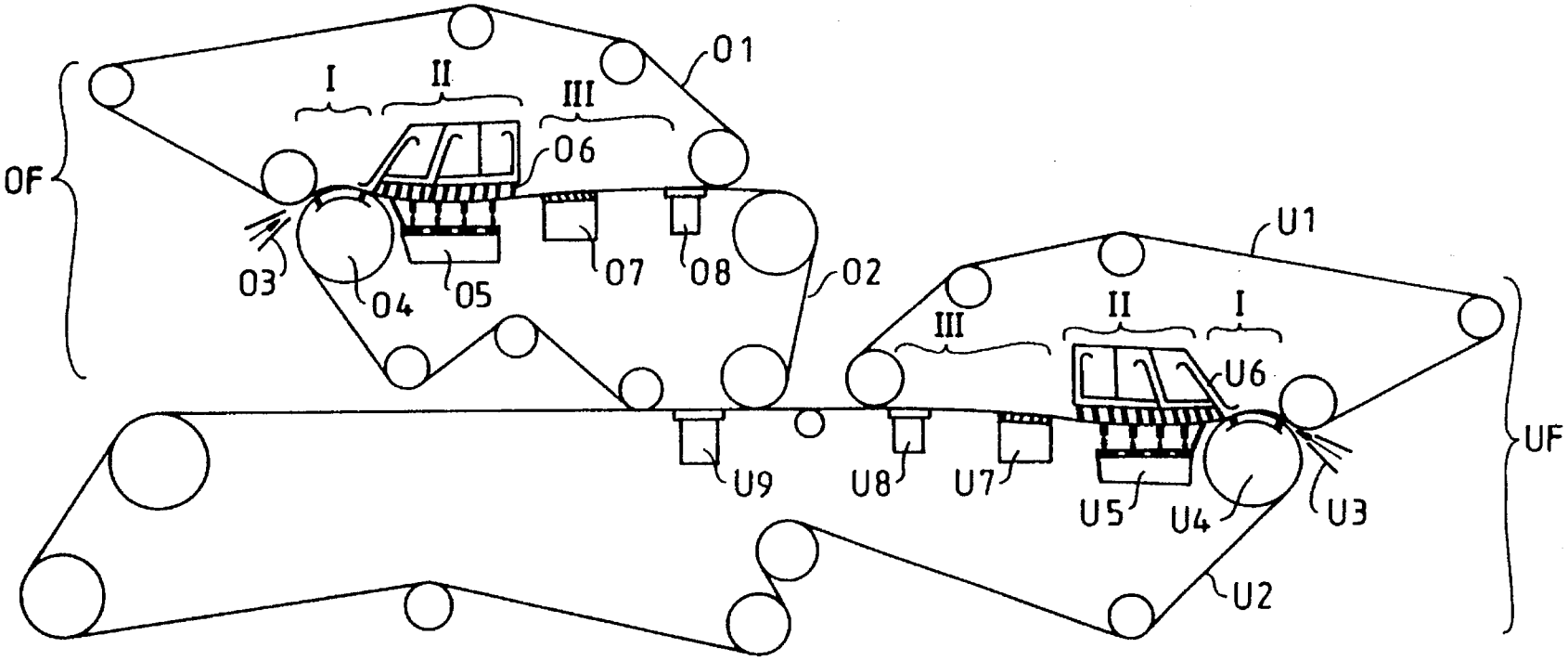
FIG. 1 is a schematic side view of a first embodiment of a twin wire forming section of a paper making machine.

FIG. 1 shows a twinned gap former including a first lower twin-wire former UF for a lower ply, layer or web and a second upper twin-wire former OF for an upper ply, layer or web of paper. The two twin-wire formers UF and OF have their respective drainage elements arranged identically as seen in the respective directions of travel of the paper webs. The directions of travel of the two web layers moved by the twin wire formers are opposite each other in FIG. 1 until the two web layers are brought together. This arrangement brings the eventually inwardly facing or inner sides of the two paper web layers, which have the same respective character, together while, the opposite outwardly facing sides of the two paper web layers, also each having the same respective character, form the two outsides of the final two ply paper web.

The two twin-wire formers are developed similarly. For each twin-wire former there are upper and lower forming section wires O1 and O2 for former OF and forming section wires U1 and U2 for former UF, respectively. Each wire travels in a respective endless loop over a corresponding set of guide elements, here rollers. The guide rollers are so placed for each wire that the pulp suspension discharged by each of the headboxes U3 and O3 respectively is enclosed in sandwich-like manner between the respective upper and lower wires into which the headboxes dispense suspension.

Directly after the headboxes U3 and O3 in each wire path, each sandwich of wires by its respective lower wire U2 and O2 is conducted through a first section I of the twin wire former, and in that section I the lower wire U2 and O2 is conducted over a respective suction roll or breast roll U4 and O4, for a first partial removal of the water from the single web layer respectively sandwiched between the wires U1 and U2 or O1 or O2.

The following section II of each twin-wire former comprises a plurality of elastically pressable ledges located within a respective suction box U5 and O5, and this suction box is located below or within the respective lower wire loop U2 and O2, i.e. the suction boxes U5 and O5 are in the same wire loops as the breast rolls U4 and O4, respectively. A combination of such ledges and a suction box like U5 is shown in U.S. Pat. No. 5,078,835 and U.S. Pat. No. 5,045,153.

Opposite the resilient ledges in boxes U5 and O5, there is another respective suction box U6 and O6 above the upper wires U2 and O2, respectively in which a 10 plurality of stationary drainage ledges are arranged. A combination of such ledges and a suction box like U6 is shown in U.S. Pat. No. 5,045,153 and EP 0 489 094 B1. The suction boxes U6 and O6 are contained within the respective wire loop of the corresponding upper wire U1 or O1.

The following section III of each former may include another stationary drainage element U7 and O7, respectively, which is contained within the loop of the respective lower wire U2 or O2. Following this drainage element within section III, a respective wire separating element U8 and O8 assists in separating the upper wire from the lower wire with the layer of paper resting on the lower wire.

Now the two layers of paper produced in the two twin wire formers are joined to form the multilayer web. As shown, the lower wire O2 of the upper twin-wire former is guided downward over a guide roller to the lower wire 42, while the lower wire U2 of the lower two in-wire former continues to travel straight ahead to the left in FIG. 1. As a result, when the lower wires O2 and U2 meet, the inner side of the layer of paper on the upper lower wire O2 comes into contact with the inner side of the layer of paper on the lower wire U2 and as the wires O2 and U2 continue moving together to the left, the two layers are sandwiched between the wires O2 and U2 forming a joint part of the respective paths of the wires. In the joint part of the path, the lower wire U2 is supported by a further suction box U9, and that box is separated from the layers of paper which are bound between the sandwiched wires. Thereafter, the upper wire O2 is raised off the web and is fed again to the upper twin-wire former OF via guide rollers while the web remains on the lower wire U2. The wire U2 next conducts the two paper layers, which have now been brought together, further to the web removal point (not shown) at the press end of the lower former UF (to the left in FIG. 1). There the lower wire U2 is then guided over several guide rollers back to the first breast roll U4.

Figure 2:
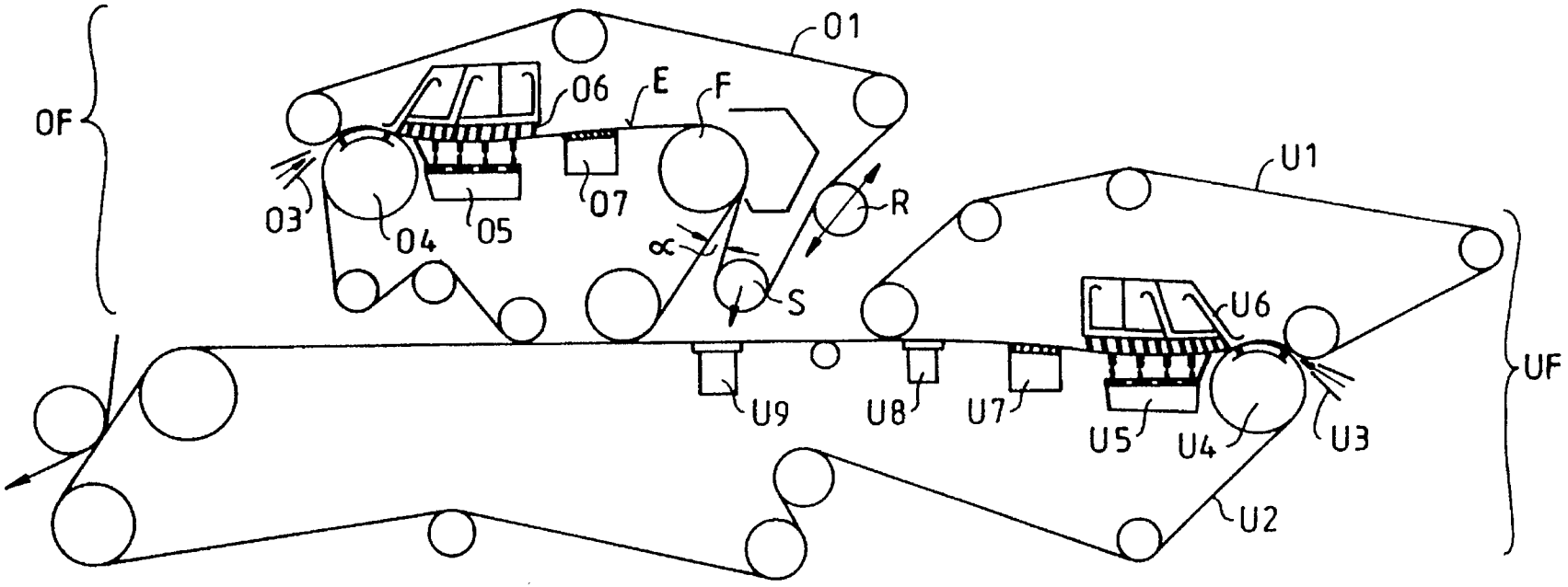
FIG. 2 similarly shows a second embodiment.

FIG. 2 shows an embodiment that is similar to that in FIG. 1. But, in this case, the separation suction box O8 in the lower wire loop of the upper wire former OF of FIG. 1 is omitted. Reliable separation of the upper wire O1 of the upper former OF from the web takes place on a smooth forming roll F off which the upper wire O1 is earlier lifted, while the lower wire O2 of the upper former OF, with the web lying on it, wraps around the forming roll F. Tensioning and regulating rolls S,R for the upper wire O1 can lie below the wire plane of the sandwiched run past or through drainage elements O4, O5, O6 and O7. As a result, a smaller structural height can be obtained in a particularly advantageous manner. The drainage causing elements in the embodiment of FIG. 2 are the same as in the embodiment of FIG. 1.

Figure 3:
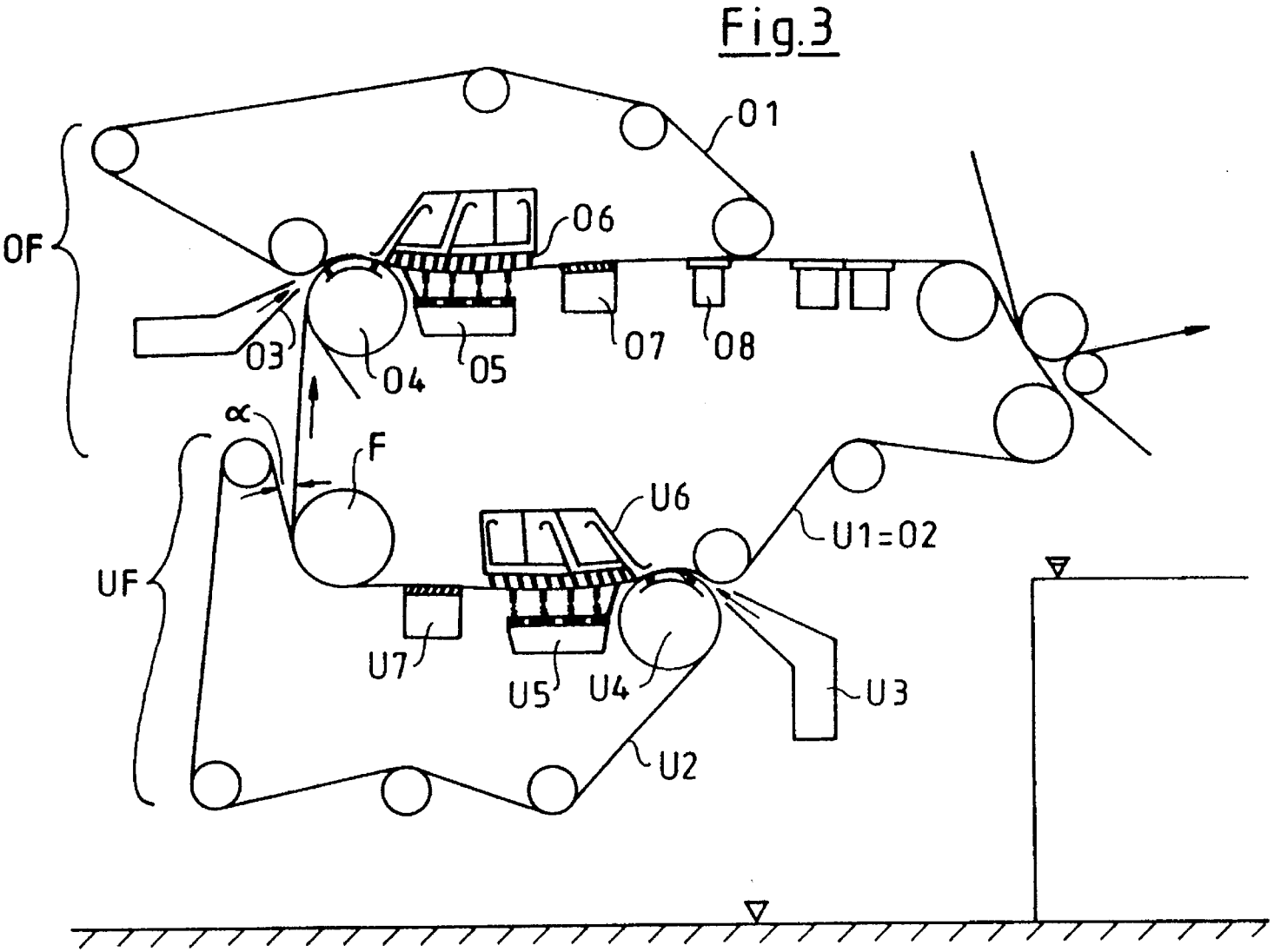
FIG. 3 similarly shows the second embodiment.

FIG. 3 shows an arrangement that is somewhat similar to FIG. 2 in that the upper and lower twin-wire formers have their drainage elements correspondingly arranged and the wires of the lower twin-wire former in FIG. 3 separate from the web in the same way around a roll F as the wires in the upper twin-wire former of FIG. 2. But, the arrangement of FIG. 3 is a particularly compact construction. This is achieved by making the lower wire O2 of the upper twin-wire former OF be the same element as the upper wire U1 of the lower twin-wire former UF. This middle wire U1, O2 conducts one web layer past drainage elements U5, 6, 7 and roll F and then past upper headbox O3 where the next layer is applied and thereafter drained by correspondingly arranged drainage elements O4, O5, O6, O7 and O8. The now multilayer web is carried to the point of discharge at the forming roll F. This arrangement would be more favorable in a building from a structural standpoint.

Figure 4:
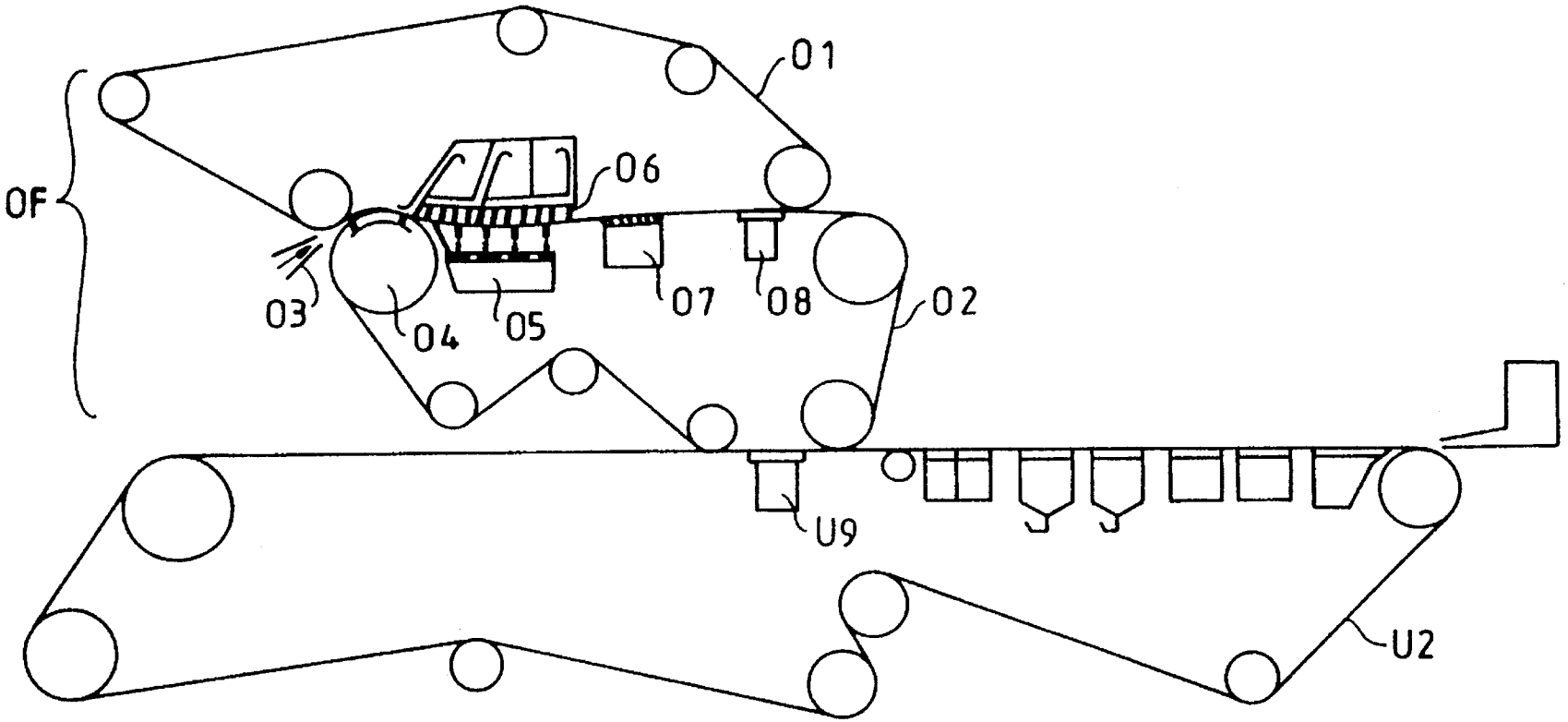
FIG. 4 similarly shows an embodiment with drainage ledges at one of the twin wire formers.
Figure 5:
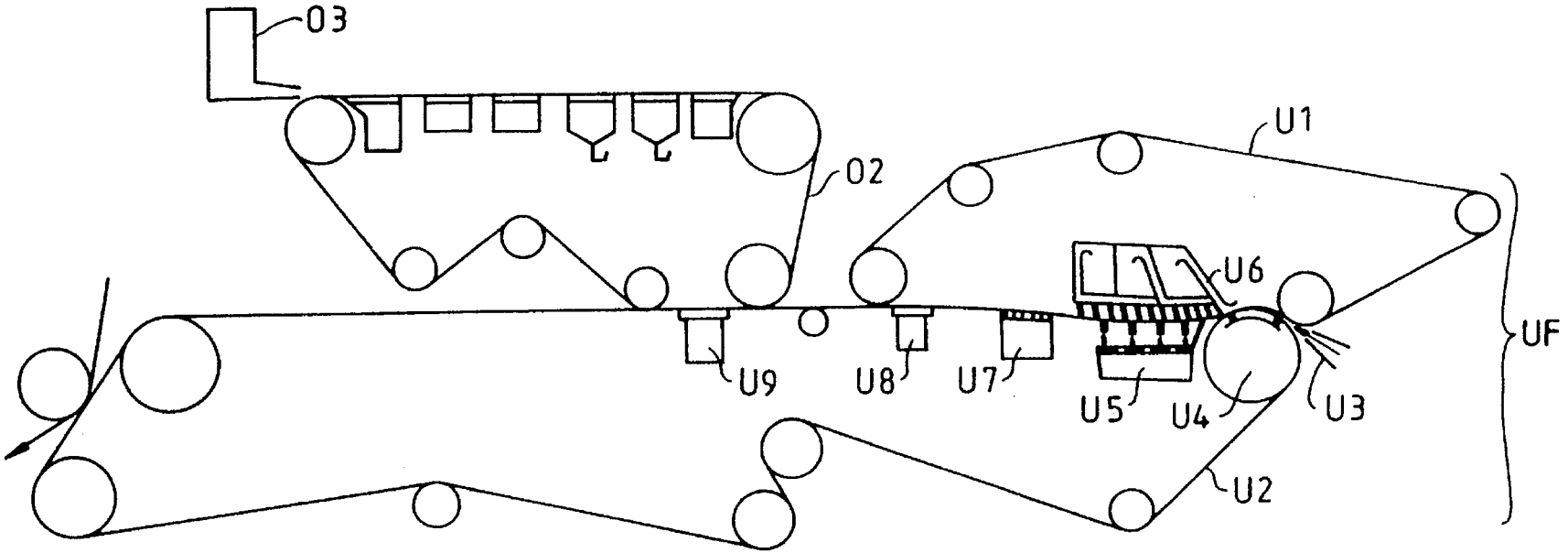
FIG. 5 shows a modification of the embodiment of FIG. 4.

FIGS. 4 and 5 show two other related variant combinations of a single long wire former with a twin-wire former in order to form a two layer paper web. Similar elements to those in the earlier embodiments are identified by the same reference numerals. In FIG. 4, there are no suction boxes with ledges U5 or U6 at the lower single wire former, while in FIG. 5, there are no suction boxes with ledges O5 or O6 at the upper single wire former. In each case, there are suction boxes with ledges only at the one of the two wire formers that is a twin wire former. In each of FIGS. 4 and 5, the web layer on the upper wire former OF is transferred to the lower wire or the lower former in the same manner as in FIG. 1.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. In a paper machine for the manufacture of a multilayer web of paper, a twin gap forming unit comprising a first and a second twin-wire web former, each web former forming a respective layer of the web, each of the first and second web formers comprising respectively:

a first web forming wire, first wire guide elements in engagement with the first wire for guiding the first wire on a respective first path;

a second web forming wire, second wire guide elements in engagement with the second wire for guiding the second wire on a respective second path;

the first and second guide elements being so placed as to guide the first and second wires on a common, horizontally extending, wire path which is less than the entire length of the first and second paths, and on the respective common wire path, the first and second wires form a sandwich for the web;

first drive means for driving the first wire and second drive means for driving the second wire to move lengthwise for carrying pulp suspension at least through the common wire path;

a headbox having an outlet for dispensing pulp suspension between the first and second wires in the common wire path;

following the headbox in the common wire path, a first drainage section comprising a first drainage element at the second wire for draining from the web through the second wire;

along the common wire path following the first drainage section, a second drainage section including opposing drainage ledges on opposite sides of the first and second wires in the common wire path, and including first drainage ledges on the side of the common wire path toward which the outwardly facing side of the web layer is formed and second drainage ledges on the side of the common wire path on which the inwardly facing side of the web layer is formed;

along the common wire path, after the second section thereof, a third drainage section including a suction applying wire separating element at one side of the common wire path for causing the wires to separate and the web to stay with the second wire, whereby the second wire has the side of the web that will face outwardly in the eventually formed multilayer web now facing toward the second wire while the side of the web that will face inwardly toward the other layer of the web now faces outwardly from the second wire;

the drainage element in the first drainage section and the drainage ledges in the second drainage section being respectively so shaped and placed that the inner and outer sides of each of the layers of the multilayer web are subject to the same respective type of drainage element ledges in each of the first and second wire formers;

the second wire of the second web former being so guided by the respective second guide elements of the second web former and the second wire of the first web former being so guided by the respective second guide elements of the first web former as to define a second joint run path between the second wires of the two web formers at a location along both second wires that is past the separation from each of the second wires of the respective first wire, for forming the multilayer web in the joint run path of both second wires;

the second guide elements of the second wire of the first web former guiding the second wire of the first web former off the second wire of the second web former such that the multilayer web thereafter travels on the second wire of the second web former;

the first and second drainage ledges at the common wire path are arranged staggered with respect to each other in the direction of travel of the wires in the common wire path;

the first drainage ledges are stationary ledges while the second drainage ledges are resiliently pressable and are opposed by the first drainage ledges; and the first drainage element comprises a suction breast roll.

2. The paper machine forming section of claim 1, further comprising suction means associated with at least the first ledges at the side of the first ledges above the first wire.

3. The paper machine forming section of claim 1, wherein the drainage ledges at the side of the web layer that will face inward of the multilayer web are the first, stationary ledges while the drainage ledges at the side of the web layer that will face outward of the multilayer web are the second, resiliently pressable ledges.

4. The paper machine forming section of claim 1, wherein the drainage ledges at the side of the web layer that will face inward of the multilayer web are the first, stationary ledges while the drainage ledges at the side of the web layer that will face outward of the multilayer web are the second, resiliently pressable ledges.

5. The paper machine forming section of claim 1, further comprising another, flat drainage element in the third section of the common wire path and preceding the suction wire separating element.

6. The paper machine wherein section of claim 1, wherein each of the first and second wires of each of the first and second web formers comprises a respective endless loop supported by the respective guide elements therefor.

7. In a paper machine for the manufacture of a multilayer web of paper, a twin gap forming unit comprising a first and a second twin-wire web former, each web former forming a respective layer of the web, each of the first and second web formers comprising respectively:

a first web forming wire, first wire guide elements in engagement with the first wire for guiding the first wire on a respective first path;

a second web forming wire, second wire guide elements in engagement with the second wire for guiding the second wire on a respective second path;

the first and second guide elements being so placed as to guide the first and second wires on a common wire path which is less than the entire length of the first and second paths, and on the respective common wire path, the first and second wires form a sandwich for the web;

first drive means for driving the first wire and second drive means for driving the second wire to move lengthwise for carrying pulp suspension at least through the common wire path;

a headbox having an outlet for dispensing pulp suspension between the first and second wires in the common wire path;

following the headbox in the common wire path, a first drainage section comprising a first drainage element at the second wire for draining from the web through the second wire;

along the common wire path following the first drainage section, a second drainage section including opposing drainage ledges on opposite sides of the first and second wires in the common wire path, and including first drainage ledges on the side of the common wire path toward which the outwardly facing side of the web layer is formed and second drainage ledges on the side of the common wire path on which the inwardly facing side of the web layer is formed;

along the common wire path, after the second section thereof, a third drainage section including a suction applying wire separating element at one side of the common wire path for causing the wires to separate and the web to stay with the second wire, whereby the second wire has the side of the web that will face outwardly in the eventually formed multilayer web now facing toward the second wire while the side of the web that will face inwardly toward the other layer of the web now faces outwardly from the second wire;

the drainage element in the first drainage section and the drainage ledges in the second drainage section being respectively so shaped and placed that the inner and outer sides of each of the layers of the multilayer web are subject to the same respective type of drainage element ledges in each of the first and second wire formers;

the second guide elements of the second wire of the first web former guiding the second wire of the first web former off the second wire of the second web former such that the multilayer web thereafter travels on the second wire of the second web former; and wherein the second wire of both of the first and the second web formers is the same wire, with the headbox of the first web former being followed by the respective common wire path of the first web former, then followed in sequence by the headbox of the second web former which is followed by the respective common wire path of the second web former; both of the second wire path of the second web former and a joint run path at which the web layers produced by the first and second web formers are formed into a multilayer web is defined at the common wire path of the second web former.

* * * * *